US005267597A

United States Patent [19]

Green

[11] Patent Number: 5,267,597

[45] Date of Patent: Dec. 7, 1993

[54] GARAGE DOOR APPARATUS

[76] Inventor: Jeffery A. Green, 1007 Edwin Dr., Channahon, Ill. 60410

[21] Appl. No.: 835,515

[22] Filed: Feb. 14, 1992

[51] Int. Cl.[5] ..... E06B 3/48

[52] U.S. Cl. ..... 160/118; 160/201; 160/188

[58] Field of Search ..... 160/36, 37, 118, 188, 160/196.1, 201, 214, 230, 231.1, 40, 229.1, 232, 310, 311

[56] References Cited

U.S. PATENT DOCUMENTS

| | | | |
|---|---|---|---|
| 2,042,002 | 5/1936 | Hovey | 160/230 X |
| 2,307,079 | 1/1943 | Sinkovitz | 160/188 X |
| 2,610,681 | 9/1952 | Schaap | 160/230 |
| 2,637,550 | 5/1953 | Ritter | 160/188 |
| 2,689,003 | 9/1954 | Helbert et al. | 160/214 X |
| 4,027,715 | 6/1977 | Tohma | 160/231.1 X |
| 4,279,454 | 7/1981 | Koiso et al. | 160/196.1 X |
| 4,800,945 | 1/1989 | Arteaga | 160/196.1 |
| 4,834,161 | 5/1989 | Johnson et al. | 160/118 X |

FOREIGN PATENT DOCUMENTS

| | | | |
|---|---|---|---|
| 201563 | 2/1966 | Sweden | 160/214 |

*Primary Examiner*—Blair M. Johnson
*Attorney, Agent, or Firm*—Leon Gilden

[57] ABSTRACT

An apparatus is arranged to include a first and second door section, each slidably mounted relative to an upper and lower guide track and channel, wherein the door sections each include door panels that are formed with an upper roller received within the upper guide track and a lower roller received within the lower channel. A worm drive mounted to an initial first panel in threaded inter-relationship effects sliding relationship of the first and second door sections relative to the upper and lower guide tracks and to a door opening.

2 Claims, 4 Drawing Sheets

GARAGE DOOR APPARATUS

BACKGROUND OF THE INVENTION

1. Field of the Invention

The field of invention relates to garage door apparatus, and more particularly pertains to a new and improved garage door apparatus wherein the same utilizes hingedly interconnected panels to permit the panels to more tightly be positioned adjacent interior wall surfaces relative to a garage door opening to provide for enhanced space relative to the door opening and garage.

2. Description of the Prior Art

Various garage door structure has been presented in the prior art to position garage door panels relative to a garage door opening. Such structure is exemplified in the U.S. Pat. No. 4,574,860 to Weiss setting forth an adjustable garage door having foldable door opening in the center, with each pair of doors mounted to a jamb to permit folding of the doors relative to the garage door opening.

U.S. Pat. No. 4,441,301 to Benson sets forth a garage door panel structure formed with an outer metallic sheet and an inner insulating polymeric foam.

U.S. Pat. No. 4,673,019 to Silverthorn sets forth a garage door screen enclosure mounted to a garage door opening.

U.S. Pat. No. 4,828,004 to Martinez, et al. sets forth a door structure for garage openings, with rigid panels hingedly mounted relative to one another.

As such, it may be appreciated that there continues to be a need for a new and improved garage door apparatus as set forth by the instant invention which addresses both the problems of ease of use as well as effectiveness in construction in providing for vertical panels mounted in a hinged relationship to permit positioning of the panels in close proximity to side wall portions of an interior garage enclosure.

SUMMARY OF THE INVENTION

In view of the foregoing disadvantages inherent in the known types of garage door apparatus now present in the prior art, the present invention provides a garage door apparatus wherein the same is arranged to include vertical hingedly mounted panels to accommodate orientation of the panels in close proximity to a garage door enclosure. As such, the general purpose of the present invention, which will be described subsequently in greater detail, is to provide a new and improved garage door apparatus which has all the advantages of the prior art garage door apparatus and none of the disadvantages.

To attain this, the present invention provides an apparatus arranged to include a first and second door section, each slidably mounted relative to an upper and lower guide track and channel, wherein the door sections each include door panels that are formed with an upper roller received within the upper guide track and a lower roller received within the lower channel. A worm drive mounted to an initial first panel in threaded inter-relationship effects sliding relationship of the first and second door sections relative to the upper and lower guide tracks and to a door opening.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garage door apparatus which has all the advantages of the prior art garage door apparatus and none of the disadvantages.

It is another object of the present invention to provide a new and improved garage door apparatus which may be easily and efficiently manufactured and marketed.

It is a further object of the present invention to provide a new and improved garage door apparatus which is of a durable and reliable construction.

An even further object of the present invention is to provide a new and improved garage door apparatus which is susceptible of a low cost of manufacture with regard to both materials and labor, and which accordingly is then susceptible of low prices of sale to the consuming public, thereby making such garage door apparatus economically available to the buying public.

Still yet another object of the present invention is to provide a new and improved garage door apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
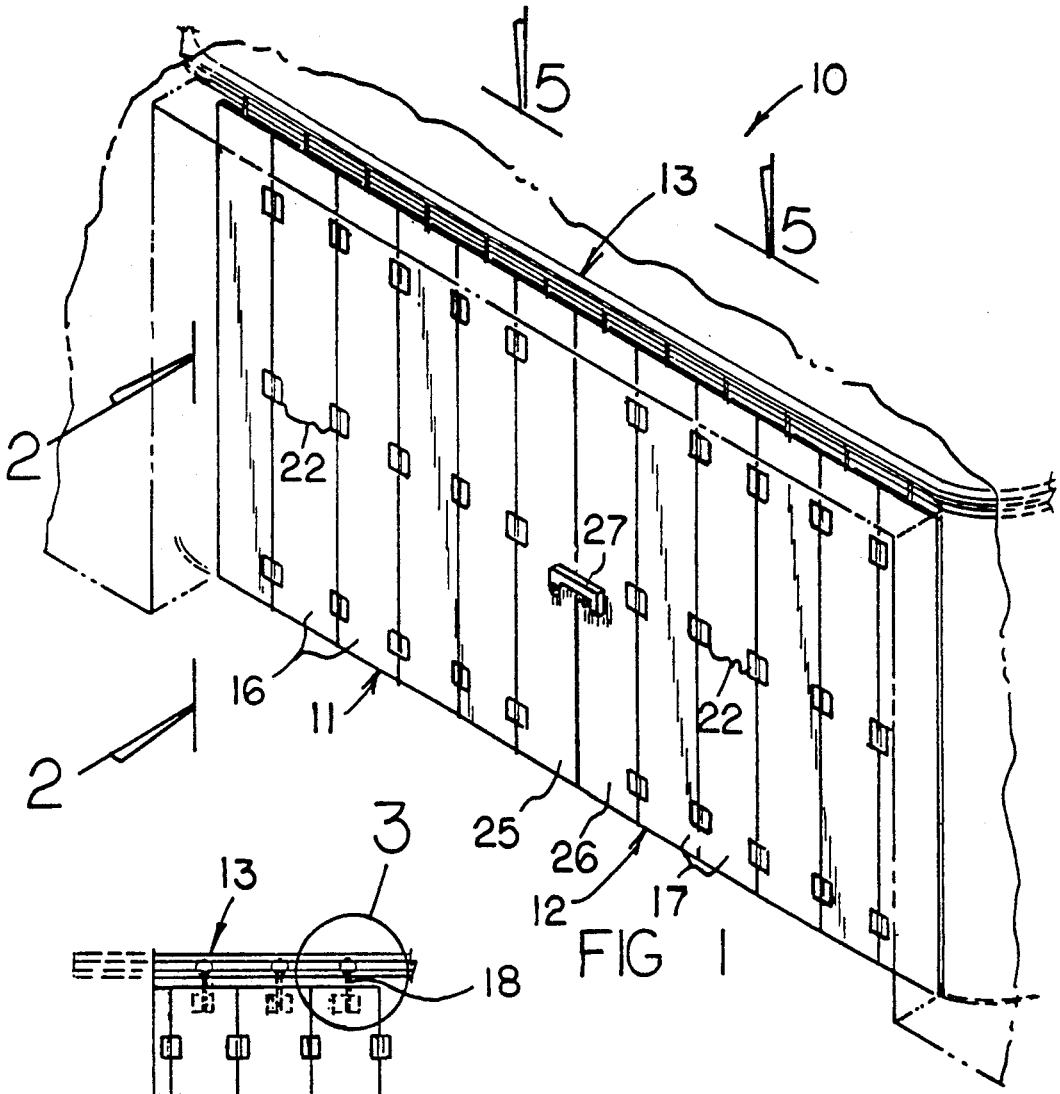
FIG. 1 is an isometric illustration of the instant invention.
Figure 2:
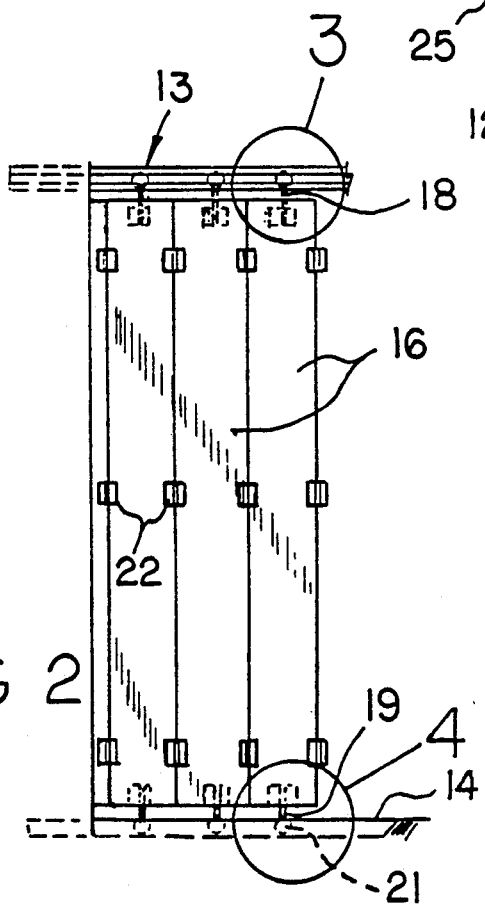
FIG. 2 is an orthographic view, taken along the lines 2—2 of FIG. 1 in the direction indicated by the arrows.
Figure 3:
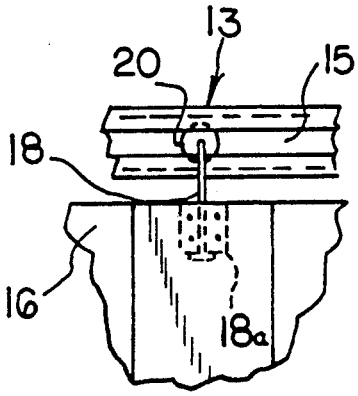
FIG. 3 is an orthographic view of section 3, as set forth in FIG. 2.
Figure 4:
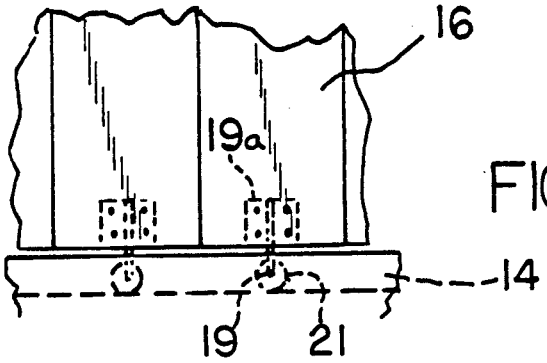
FIG. 4 is an orthographic view of section 4, as set forth in FIG. 2.
Figure 5:
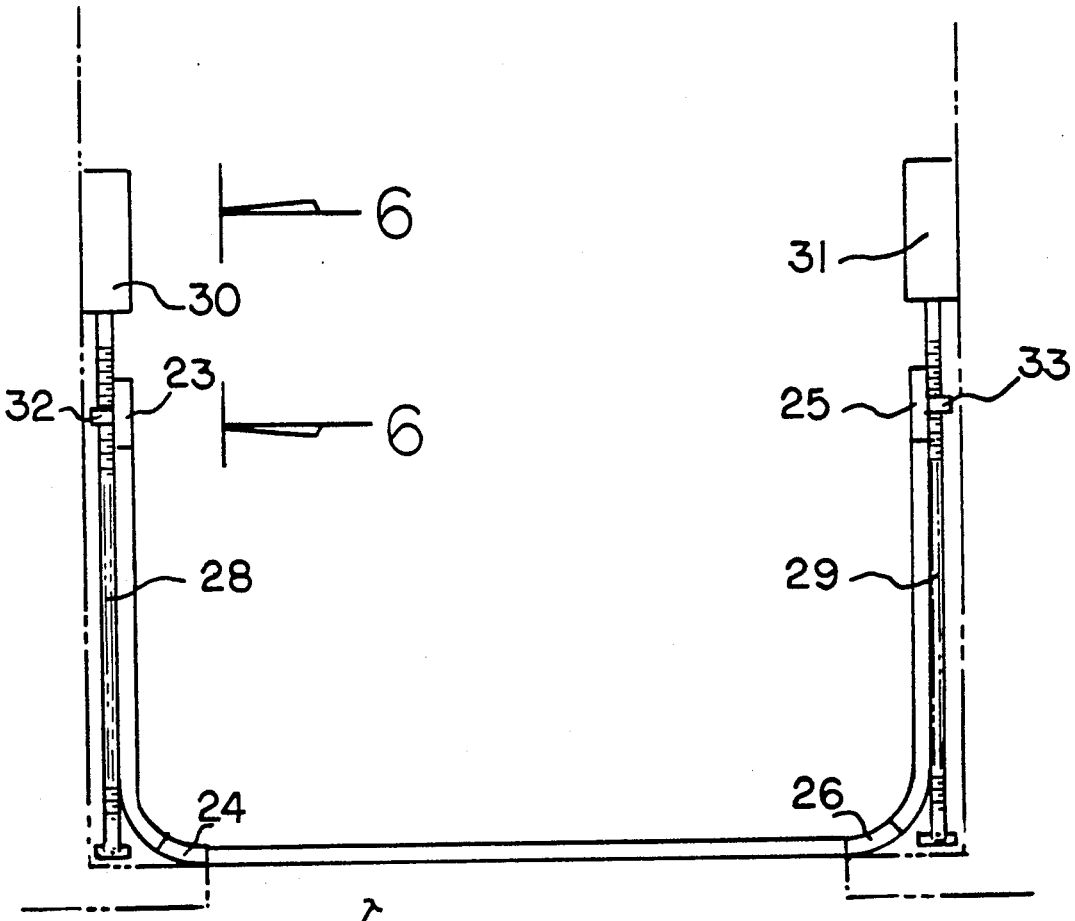
FIG. 5 is an orthographic view, taken along the lines 5—5 of FIG. 1 in the direction indicated by the arrows.
Figure 6:
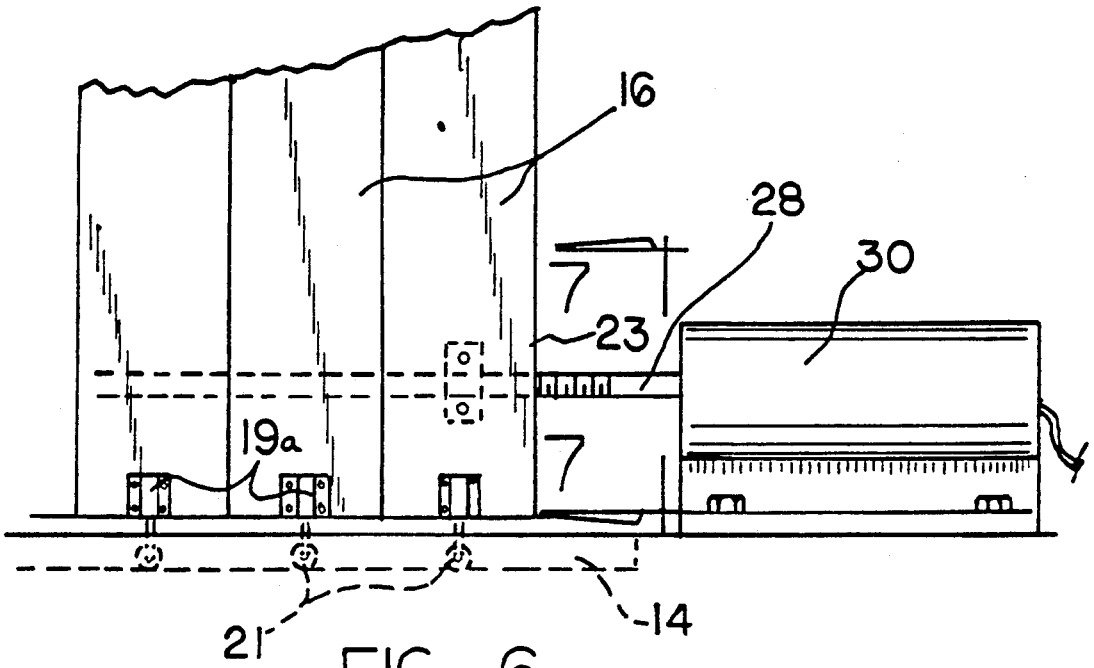
FIG. 6 is an orthographic view, taken along the lines 6—6 of FIG. 5 in the direction indicated by the arrows.
Figure 7:
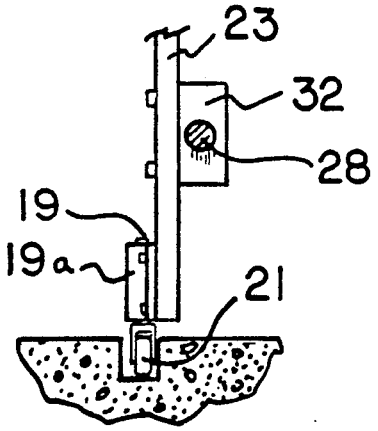
FIG. 7 is an orthographic view, taken along the lines 7—7 of FIG. 6 in the direction indicated by the arrows.

With reference now to the drawings, and in particular to FIGS. 1 to 10 thereof, a new and improved garage door apparatus embodying the principles and concepts of the present invention and generally designated by the reference numeral 10 will be described.

More specifically, the garage door apparatus 10 of the instant invention essentially comprises a first door section 11 and a second door section 12 slidably mounted relative to a door opening 9, with the first and second door sections 11 and 12 respectively slidably mounted at their upper ends to an upper guide track 13 and at their lower ends to a lower channel 14. The upper guide track 13 is of a generally C-shaped cross-sectional configuration, including an upper guide track slot 15 directed through a side wall of the upper guide track, with the track slide 15 coextensive with the guide track 13. The first and second door sections 11 and 12 include respective first and second door panels 16 and 17 arranged in an adjacency and coextensive relationship relative to one another and parallel relative to one another coextensively about the first and second door sections 11 and 12. Each first and second panel 16 and 17 upper end includes an upper guide shaft 18 rotatably mounted thereto within an upper guide shaft bushing 18*a*. The upper distal end of the guide shaft 18 rotatably mounts an upper roller wheel 20, with each upper roller wheel 20 received within the upper guide track 13. A panel lower guide shaft 19 directed downwardly relative to each first and second door panel 16 and 17 is rotatably mounted within a lower guide shaft bushing 19*a*, with a lower roller wheel 21 received within the lower channel 14. Each of the first and second panels are hingedly mounted relative to one another by hinge members 22 in the configuration as illustrated in the FIG. 1 for example. The initial first panel 23 and the initial second panel 25 each include an internally threaded first and second respective lug 32 and 33. Threadedly directed through the respective first and second lug 32 and 33 is a respective first and second worm drive screw 28 and 29 mounted to respective first and second drive motor 30 and 31 to effect selective rotation of the worm drive screws 28 and 29 to direct the initial first and second panels 23 and 25 along the worm drive screw and thereby direct the first and second door sections 11 and 12 relative to the door opening 9. The penultimate first panel 24 and the penultimate second panel 26 (see FIG. 1) include a latch assembly 27 cooperative therebetween to secure the first and second door sections 11 and 12 together in a closed configuration, as illustrated in the FIG. 1.

Figure 9:
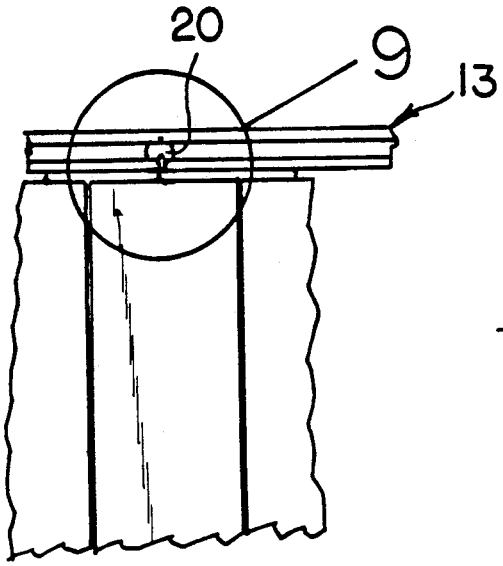
FIG. 9 is an orthographic view of section 9, as set forth in FIG. 8.
Figure 9:
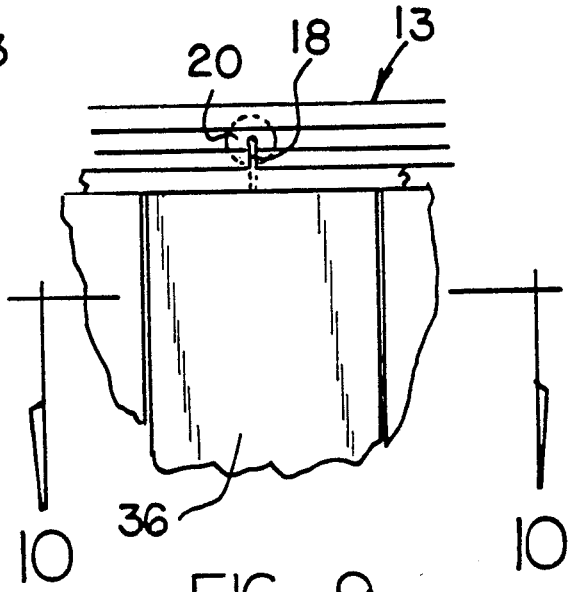
Figure 8:
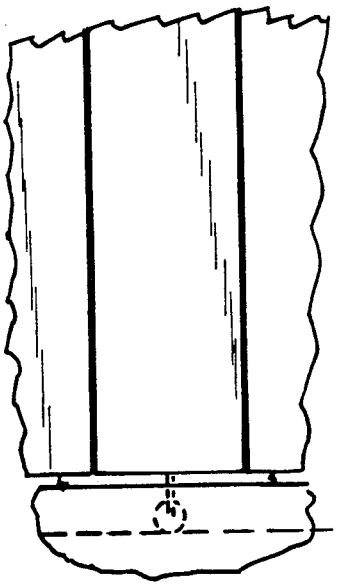
FIG. 8 is an orthographic view of a modified door panel structure of the invention.
Figure 10:
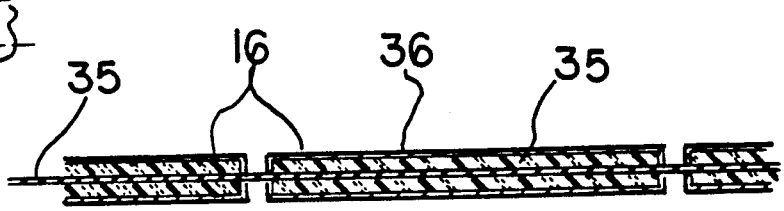
FIG. 10 is an orthographic view, taken along the lines 10—10 of FIG. 9 in the direction indicated by the arrows.

The FIGS. 8-10 illustrate the first and second panels to utilize a continuous polymeric flexible web 34 coextensive between the first and second door sections 11 and 12 and extending between the panels, in a manner as illustrated in FIG. 10. Each of the panels includes a rigid panel housing 36 coextensively arranged in surrounding relationship relative to each panel, and each including a polymeric insulation 35 therewithin. In this manner, insulation as well as providing for a continuous barrier relative to sealing of the garage door structure to environmental conditions is provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garage door apparatus mounted within a door opening, with the apparatus including an upper guide track spaced from and parallel a lower channel, the upper guide track is arranged in a coextensive relationship relative to the lower channel, and a first door section slidably mounted within the upper guide track and the lower channel, orthogonally oriented between the upper guide track and the lower channel, and a second section slidably mounted within the upper guide track and the lower channel, orthogonally oriented between the upper guide track and the lower channel, with the first door section including a plurality of parallel coextensive first panels, and the second door section including a plurality of parallel and coextensive second panels, with each of the first panels and the second panels each slidably mounted relative to the upper guide track, and each lower end of the first panels and the second panels slidably mounted relative to the lower channel, and each upper end of the first panels and the second panels includes an upper guide shaft, each upper guide shaft orthogonally oriented relative to the upper guide track, and each upper guide shaft including an upper guide shaft bushing, with the upper guide shaft rotatably mounted within the bushing, and the upper guide shaft including an upper roller wheel received within the upper guide track, the upper guide track formed of a generally C-shaped cross-sectional configuration, including an upper guide track side wall and the upper guide track side wall including a slot coextensive with the side wall, with the upper guide shaft directed through the slot, and each lower end of each first and second panel including a lower guide shaft and each lower guide shaft rotatably mounted within a lower guide shaft bushing, and each lower guide shaft including a lower roller wheel, each lower roller wheel received within the lower channel, and the first door section and the second door section includes a respective initial substantially planar first panel and an initial substantially planar second panel respectively, and a penultimate first panel and a penultimate second panel, the penultimate first panel and the penultimate second panel including a latch assembly cooperative therebetween to secure the penultimate first panel and the penultimate second panel in a contiguous relationship relative to one another, and the initial first panel includes an internally threaded first lug fixedly mounted directly thereon and the initial second panel includes an internally threaded second lug fixedly mounted directly thereon, each of said lugs defining a threaded axis, each of said axis being parallel to the respective planar first and second panel, and a first worm drive screw threadedly directed through the first lug and a second worm drive screw threadedly directed through the second lug, the first worm drive screw and the second worm drive screw arranged between and parallel relative to the upper guide track and the lower channel, and the first worm drive screw including a first drive motor to effect selective rotation of the first worm drive screw and the second worm drive screw including a second drive motor to effect selective rotation of the second worm drive screw to effect reciprocation of the first door section and the second door section relative to the door opening.

2. An apparatus as set forth in claim 1 wherein the first door section and the second door section each includes a respective continuous polymeric web coextensive therewith, and each first panel and each second panel includes a rigid panel housing receiving the continuous polymeric web medially therebetween, and each first panel and each second panel includes a polymeric insulation arranged coextensively within each housing, wherein the polymeric web between adjacent panels effects a hinged relationship between the panels.

* * * * *